US010392854B2

(12) United States Patent
Ottmann et al.

(10) Patent No.: US 10,392,854 B2
(45) Date of Patent: Aug. 27, 2019

(54) SYSTEMS AND METHODS FOR AN AUTOMATIC SLIDING DOOR HAVING A SLIDE AND RAIL ASSEMBLY

(71) Applicant: TECHNOLOGY CONSTRUCTION, INC., Prescott, AZ (US)

(72) Inventors: Michael H. Ottmann, Prescott, AZ (US); Paul Cuillier, Tucson, AZ (US); Richard N. Dennis, Glendale, AZ (US); Patrick Marcus, Tucson, AZ (US); Jonathon Cox, Prescott, AZ (US)

( * ) Notice: Subject to any disclaimer, the term of this patent is extended or adjusted under 35 U.S.C. 154(b) by 0 days.

(21) Appl. No.: 15/429,906

(22) Filed: Feb. 10, 2017

(65) Prior Publication Data

US 2017/0234055 A1 Aug. 17, 2017

Related U.S. Application Data

(60) Provisional application No. 62/293,941, filed on Feb. 11, 2016.

(51) Int. Cl.
*E05F 15/643* (2015.01)
*E05D 15/06* (2006.01)

(52) U.S. Cl.
CPC ..... *E05F 15/643* (2015.01); *E05D 15/0652* (2013.01); *E05Y 2400/32* (2013.01); *E05Y 2600/626* (2013.01); *E05Y 2900/132* (2013.01)

(58) Field of Classification Search
CPC .. E05F 15/643; E05F 15/0691; E05F 15/0652
See application file for complete search history.

(56) References Cited

U.S. PATENT DOCUMENTS

| | | | | |
|---|---|---|---|---|
| 3,495,353 | A | 2/1970 | Forsberg | |
| 4,338,553 | A * | 7/1982 | Scott, Jr. | H02H 7/0851 318/266 |
| 4,563,625 | A | 1/1986 | Kornbrekke et al. | |
| 5,347,755 | A | 9/1994 | Jaster et al. | |
| 5,797,471 | A * | 8/1998 | Princell | B66B 13/08 187/318 |
| 6,698,138 | B1 | 3/2004 | Lin | |
| 6,918,210 | B1 * | 7/2005 | Smiley | E05F 15/643 49/347 |
| 7,712,378 | B2 | 5/2010 | Park | |
| 9,856,688 | B2 * | 1/2018 | Elie | F16H 19/06 |
| 2004/0074046 | A1 * | 4/2004 | Mimnaugh | E05D 15/063 16/96 R |
| 2004/0100169 | A1 * | 5/2004 | Huber | A47B 88/457 312/319.5 |
| 2006/0230575 | A1 * | 10/2006 | Quinn | E05D 15/0647 16/87.2 |
| 2007/0018790 | A1 | 1/2007 | LaFrance | |

(Continued)

FOREIGN PATENT DOCUMENTS

| | | | | |
|---|---|---|---|---|
| EP | 2907956 | A1 | 8/2015 | |
| JP | 11166366 | A * | 6/1999 | E05F 17/004 |

*Primary Examiner* — Marcus Menezes
(74) *Attorney, Agent, or Firm* — Polsinelli PC; Ari M. Bai

(57) ABSTRACT

Embodiments for an automated sliding door system having a slide and rail assembly engaged to a door panel for automatically sliding the door panel relative to a door frame are described. The slide and rail assembly is in operative communication with microprocessor that executes software to adjust various operational parameters of the slide and rail assembly to operate the automatic sliding door.

9 Claims, 17 Drawing Sheets

(56) References Cited

U.S. PATENT DOCUMENTS

| | | | | |
|---|---|---|---|---|
| 2007/0108927 | A1* | 5/2007 | Valencia | E05F 17/004 318/282 |
| 2009/0077898 | A1 | 3/2009 | Gerichten | |
| 2011/0050061 | A1* | 3/2011 | Gasser | E05F 15/643 312/319.7 |
| 2014/0013668 | A1* | 1/2014 | Balbach | E05D 15/0652 49/409 |
| 2014/0047768 | A1* | 2/2014 | Vaknin | E05D 15/06 49/25 |

* cited by examiner

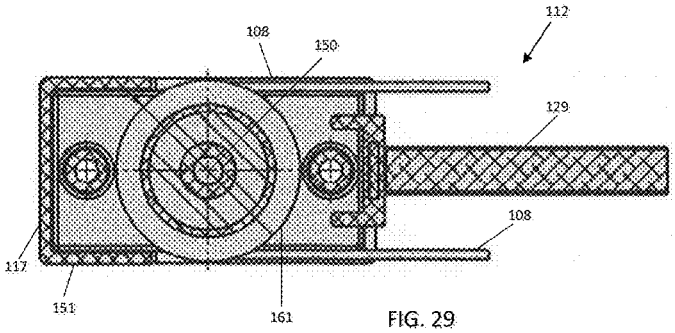
FIG. 29
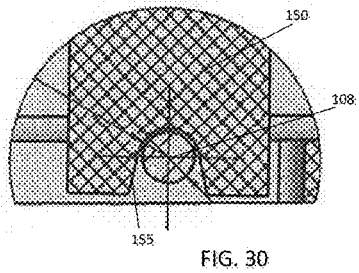
FIG. 30
FIG. 28
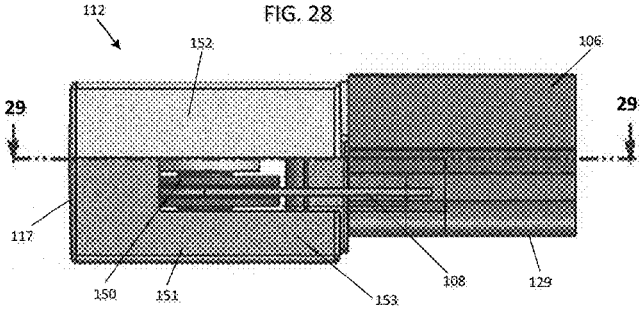

SYSTEMS AND METHODS FOR AN AUTOMATIC SLIDING DOOR HAVING A SLIDE AND RAIL ASSEMBLY

CROSS REFERENCE TO RELATED APPLICATIONS

This is a non-provisional application that claims benefit to U.S. provisional application Ser. No. 62/293,941, filed on Feb. 11, 2016, which is herein incorporated by reference in its entirety.

FIELD

The present disclosure relates to an automatic sliding door system and in particular to systems and methods for an automatic sliding door having a slide and rail assembly.

BACKGROUND

Automatic sliding doors in both residential and commercial applications allow a door to slide automatically between closed and open positions. Typically, automatic sliding doors include a motor and activation system to open and close them. The advantages of automatic sliding doors is that very little room is required to open the door, they are relatively easy to automate and they also tend to be secure, since the doors cannot be lifted out of their hinges. However, the various motor and activation systems used with automatic sliding doors, commonly referred to as sliding door operators, may include an electric motor, geared down to get a lower speed and a higher torque, drives a pulley at one end of a belt. The sliding door may be clamped to the belt. To open the door, the motor turns the pulley, which in turn turns the belt, which in turn actuates and slides the door. To close the door, the reverse occurs. However, further improvements in sliding door technology are desired to enhance the operation of the automatic sliding door in both residential and commercial applications.

BRIEF DESCRIPTION OF THE DRAWINGS

FIG. 28 is a side view of the pulley component engaged to the slide rail, according to one aspect of the present disclosure;

FIG. 29 is a cross-sectional view of the pulley component taken along line 29-29 of FIG. 28, according to one aspect of the present disclosure;

FIG. 30 is an enlarged view of the spool for the pulley component shown in FIG. 26 showing a top cord engaged between the spool drive component and the pulley component, according to one aspect of the present disclosure;

Corresponding reference characters indicate corresponding elements among the view of the drawings. The headings used in the figures do not limit the scope of the claims.

DETAILED DESCRIPTION

Figure 1:
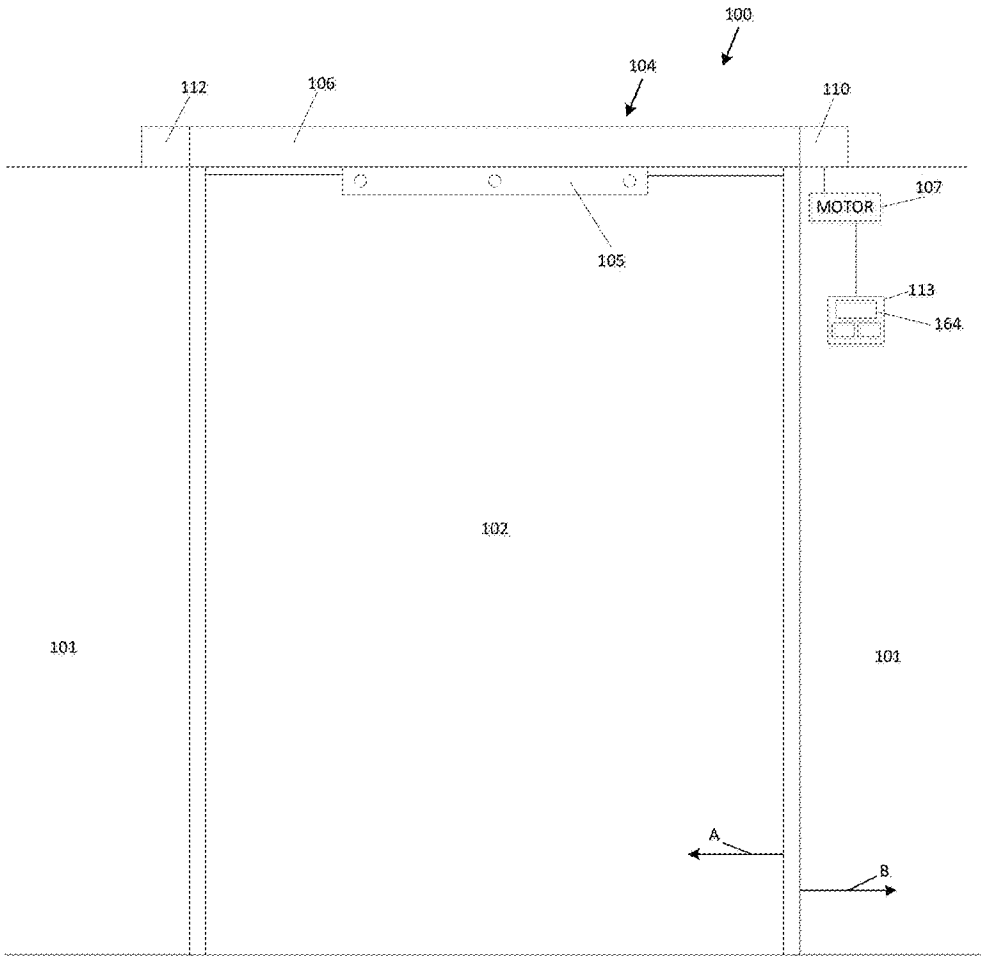
FIG. 1 is a perspective view of an automatic sliding door system having a slide and rail assembly operatively coupled to a door panel and frame, according to one aspect of the present disclosure.
Figure 2:
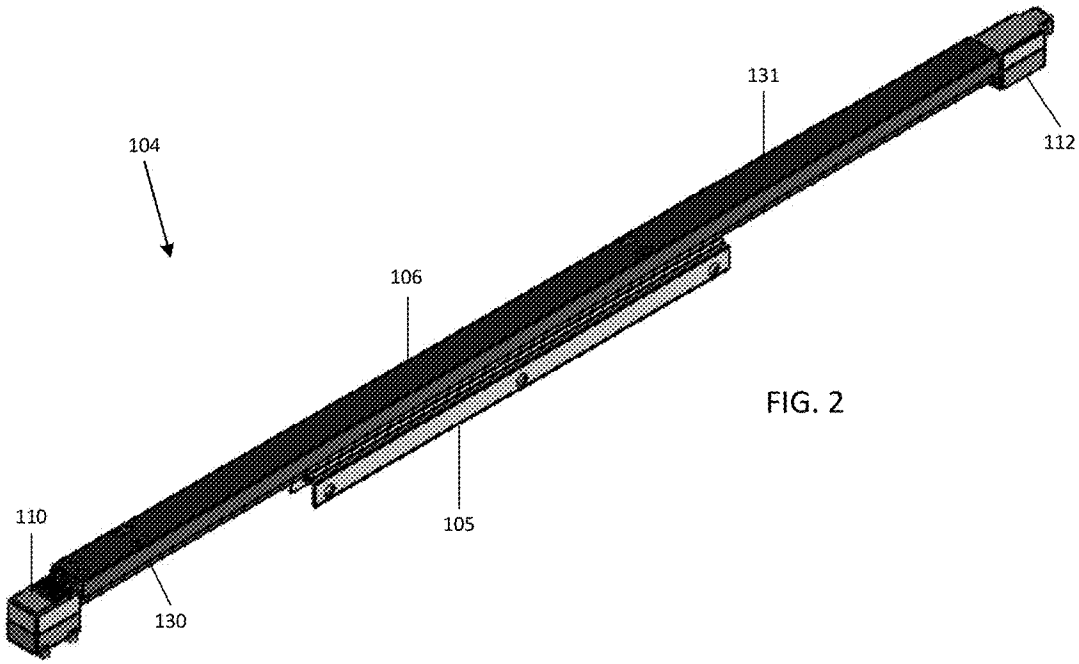
FIG. 2 is a perspective view of the slide and rail assembly of FIG. 1, according to one aspect of the present disclosure.
Figure 8:
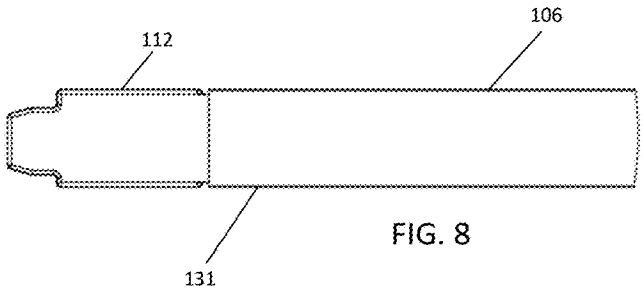
FIG. 8 is an enlarged view of a pulley component of the slide and rail assembly of FIG. 3, according to one aspect of the present disclosure.
Figure 7:
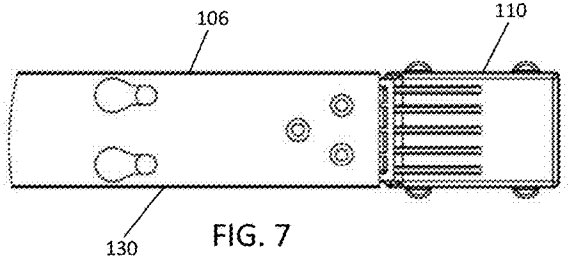
FIG. 7 is an enlarged view of a spool drive box of the slide and rail assembly of FIG. 3, according to one aspect of the present disclosure.
Figure 3:
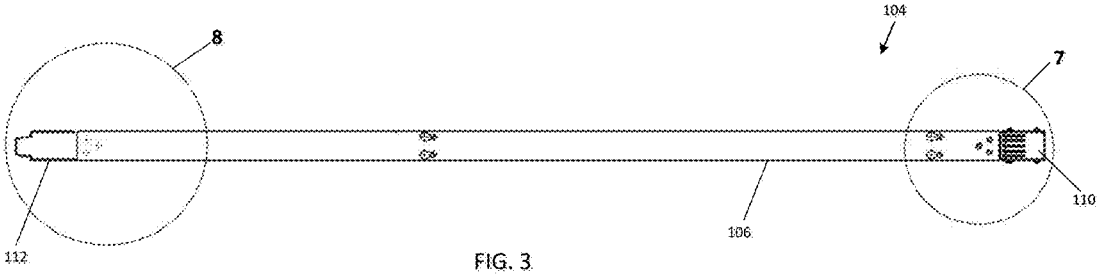
FIG. 3 is a bottom view of the slide and rail assembly of FIG. 2, according to one aspect of the present disclosure.
Figure 10:
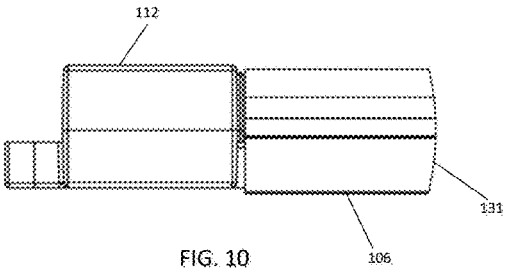
FIG. 10 is an enlarged view of the pulley component of the slide and rail assembly of FIG. 4, according to aspects of the present disclosure.
Figure 9:
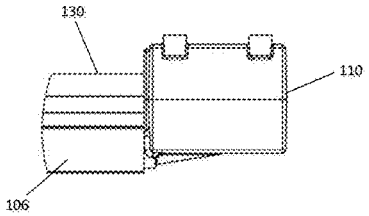
FIG. 9 is an enlarged view of the spool drive box of the slide and rail assembly of FIG. 4, according to aspects of the present disclosure.
Figure 6:
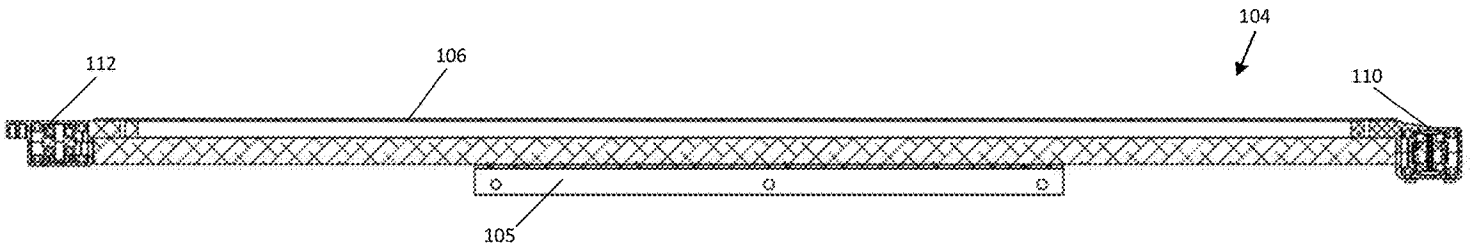
FIG. 6 is a cross-sectional view of the slide and rail assembly of FIG. 5 taken along line 6-6, according to one aspect of the present disclosure.
Figure 5:
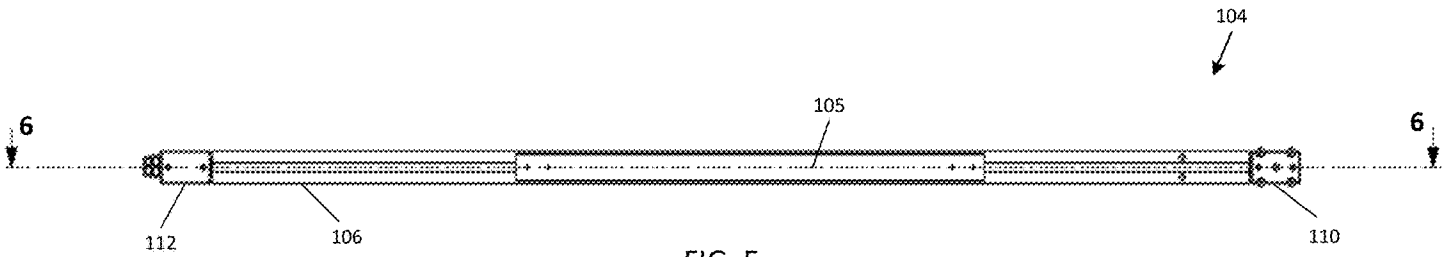
FIG. 5 is a top view of the slide and rail assembly of FIG. 2, according to one aspect of the present disclosure.
Figure 4:
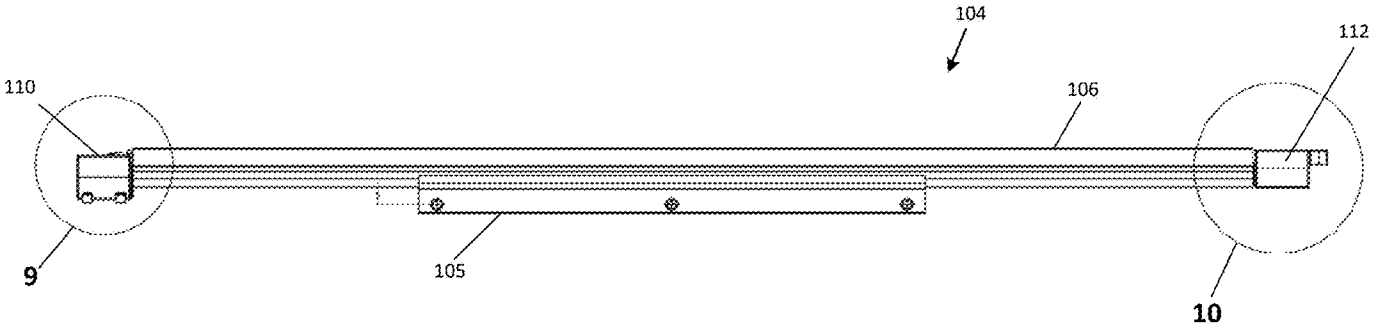
FIG. 4 is a side view of the slide and rail assembly of FIG. 2, according to one aspect of the present disclosure.

Aspects of the present disclosure involve systems and methods for an automatic sliding door having a slide and rail assembly for commercial or residential applications. In one aspect, the systems and methods described herein provide for a slide and rail assembly that allows an automatic sliding door in the open position to close when only small pressure is applied to a normal vector along the edge of the automatic sliding door in which the degree of pressure required to close the sliding door is adjustable using software executed on a microprocessor. The presently disclosed technology utilizes a slide and rail assembly that is in operative communication with microprocessor that executes software to adjust various operational parameters of the slide and rail assembly to operate the automatic sliding door. Referring to the drawings, embodiments of an automatic sliding door system having a slide and rail assembly are illustrated and generally indicated as 100 in FIGS. 1-32.

Figure 31:
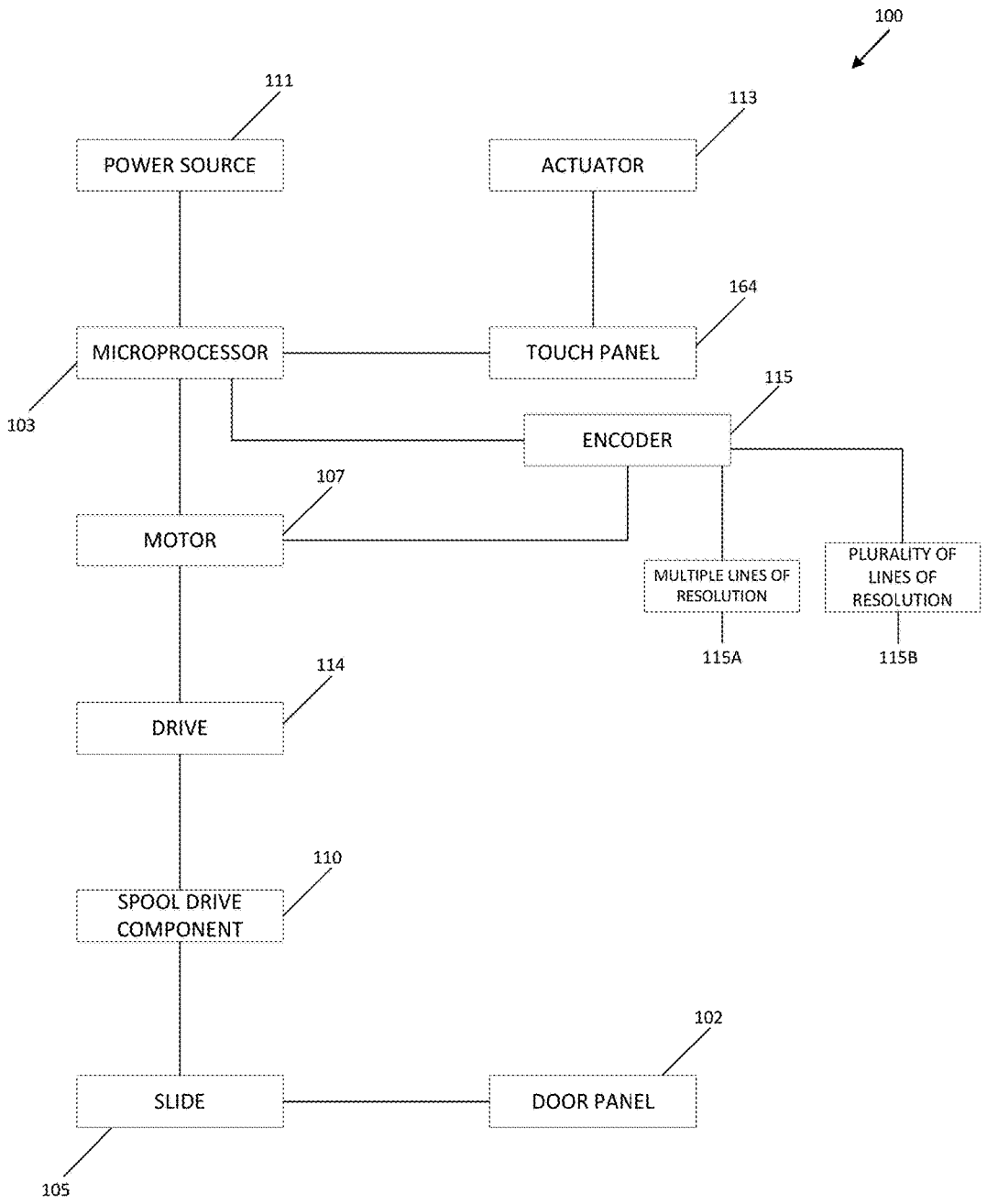
FIG. 31 is a simplified block diagram of the various basic components of the automatic slide and rail assembly system, according to one aspect of the present disclosure.

Referring to FIG. 1, one embodiment of the automatic sliding door system 100 includes a sliding door panel 102 that is operatively coupled to a frame 101 through a slide and rail assembly 104 that allows the sliding door panel 102 to automatically slide between open and closed positions. The slide and rail assembly 104 is drives the sliding door panel 102 between the open and closed positions by a motor 107 that is in operative engagement with the slide and rail assembly 104. As shown in FIGS. 1 and 31, the motor 107 communicates with an actuator 113 through a touch panel 164 which functions to actuate the sliding door panel 104 either remotely or directly between open and closed positions as shall be described in greater detail below.

Referring to FIGS. 1-14, the slide and rail assembly 104 includes a slide 105 that is in sliding engagement with a linear slide rail 106 through a linear run 129 that extends along the length of the linear slide rail 106. As shown in FIG. 1, the linear slide rail 106 is secured to the frame 101 and the slide 105 is directly engaged to the top portion of the sliding door panel 102 for operating the sliding door panel 102 between open and closed positions.

Figure 12:
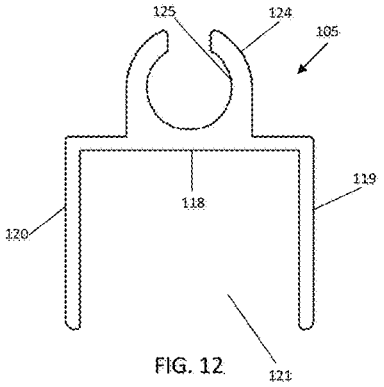
FIG. 12 is an end view of the slide of FIG. 11, according to aspects of the present disclosure.
Figure 11:
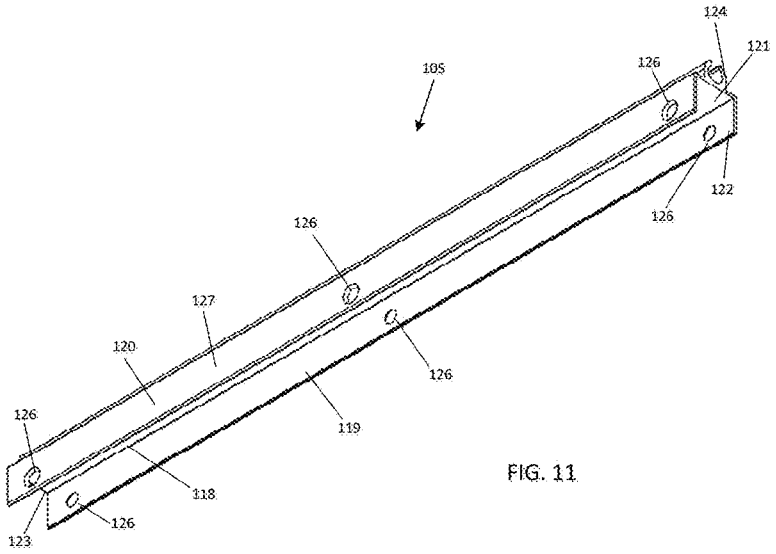
FIG. 11 is a perspective view of a slide for the slide and rail assembly, according to one aspect of the present disclosure.

As shown in FIGS. 11 and 12, the slide 105 includes an elongated body 127 collectively defined by a middle portion 118, a first side portion 119 and a second side portion 120 such that an open channel 121 is collectively formed which is configured to receive the top portion of the door panel 102 (FIG. 1). In addition, the open channel 121 communicates with a distal open end 122 formed at one end of the slide 105 and a proximal open end 123 formed at the opposite end of the slide 105. The middle portion 118 of the slide 105 further defines an elongated runner portion 124 having a channel 125 that extends the length of the slide 105 and provides a surface for engaging the linear run 129 of the linear slide rail 106 to the slide 105. In some embodiments, the first and second side portions 119 and 120 may define a plurality of aligned apertures 126 configured to receive a respective securing member (not shown) that secures the top portion of the door panel 102 within the open channel 121 of the slide 105.

Figure 14:
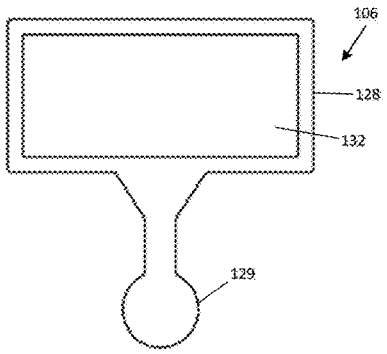
FIG. 14 is an end view of the linear slide rail, according to one aspect of the present disclosure.
Figure 13:
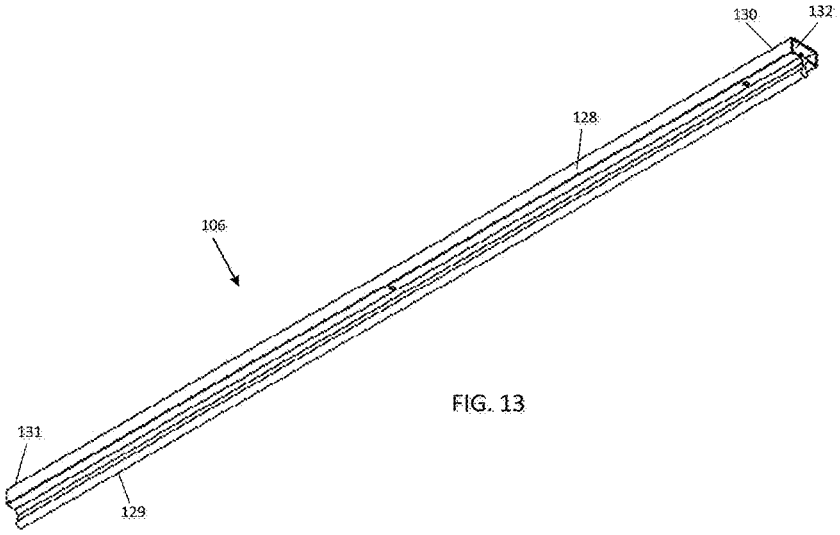
FIG. 13 is a perspective view of a linear slide rail for the slide and rail assembly, according to one aspect of the present disclosure.

Referring to FIGS. 13 and 14, the linear slide rail 106 includes an elongated housing 128 that defines a channel 132 that communicates between a distal open end 130 formed at one end of the elongated housing 128 and a proximal open end 131 at an opposite end of the elongated housing 128. As shown, the linear run 129 extends the length of the linear slide rail 106 and is configured to be disposed within the open channel 125 of the runner portion 124 such that the slide 105 may be driven along the linear run 129 by operation of the motor 107.

Figure 32:
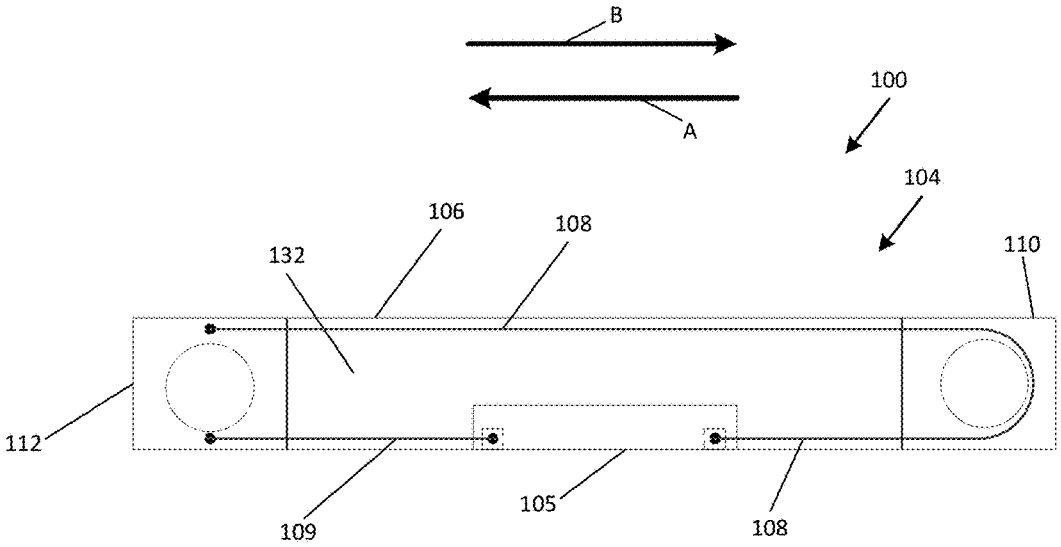
FIG. 32 is a simplified illustration showing the connection of top cord between the spool drive component and the slide and the connection of the bottom cord between the spool drive component and the slide, according to one aspect of the present disclosure.

As shown in FIGS. 1-10 and 15-22, the slide and rail assembly 104 further includes a spool drive component 110 engaged to the distal open end 130 of the linear slide rail 106 and a pulley component 112 engaged to the proximal open end 131 of the linear slide rail 106. Referring to FIG. 32, the spool drive component 110 drives a top cord 108 and a bottom cord 109 coupled between the spool drive component 110, pulley component 112, and slide 105. As shown, the bottom cord 108 is engaged between the spool drive component 110 and the proximal open end 123 of the slide 105 as well as being coupled around the pulley component 112, while the bottom cord 109 is engaged between the spool drive component 110 and the distal open end 123 of the slide 105. In one aspect, the spool drive component 110 is operable to drive the top cord 108 in the proximal direction B and the bottom cord 109 concurrently in the distal direction A such that the slide 105 and the door panel 102 are driven in the distal direction A (e.g., open position). Conversely, the spool drive component 110 is operable to drive the top cord 108 in the distal direction A and the bottom cord 108 concurrently in the proximal direction B such that the slide 105 and door panel 102 are now driven in the proximal direction B (e.g., closed position).

Figure 15:
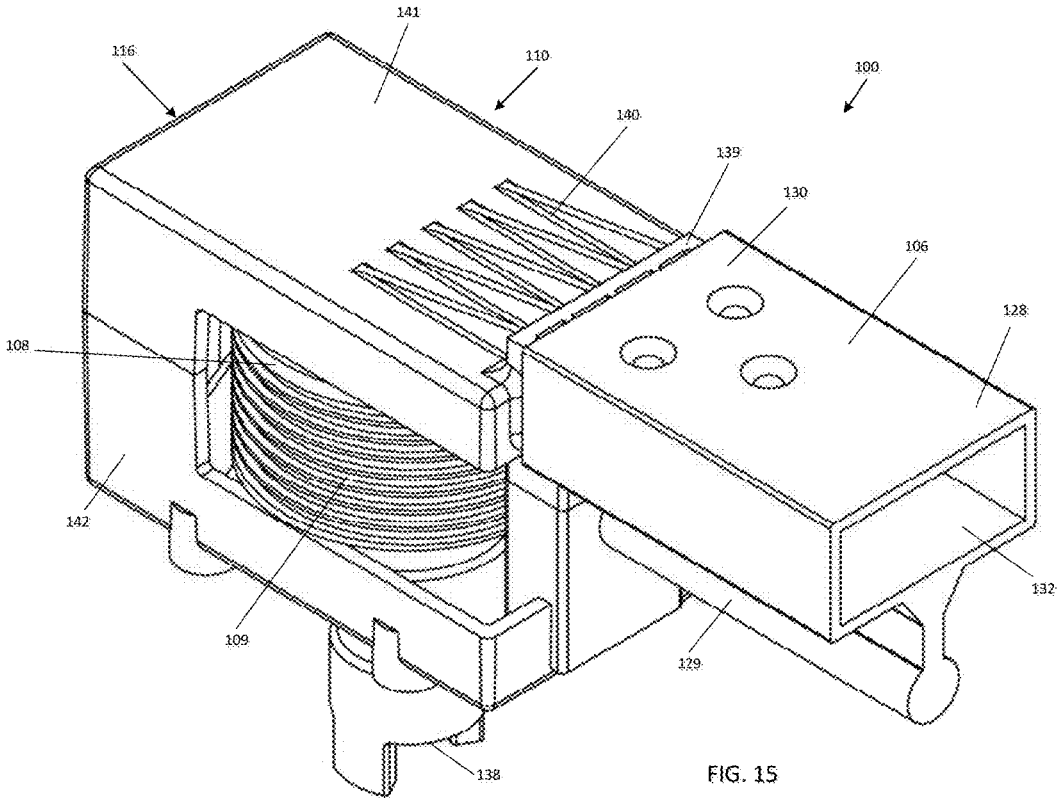
FIG. 15 is a perspective view of the spool drive box of FIG. 2, according to one aspect of the present disclosure.
Figure 16:
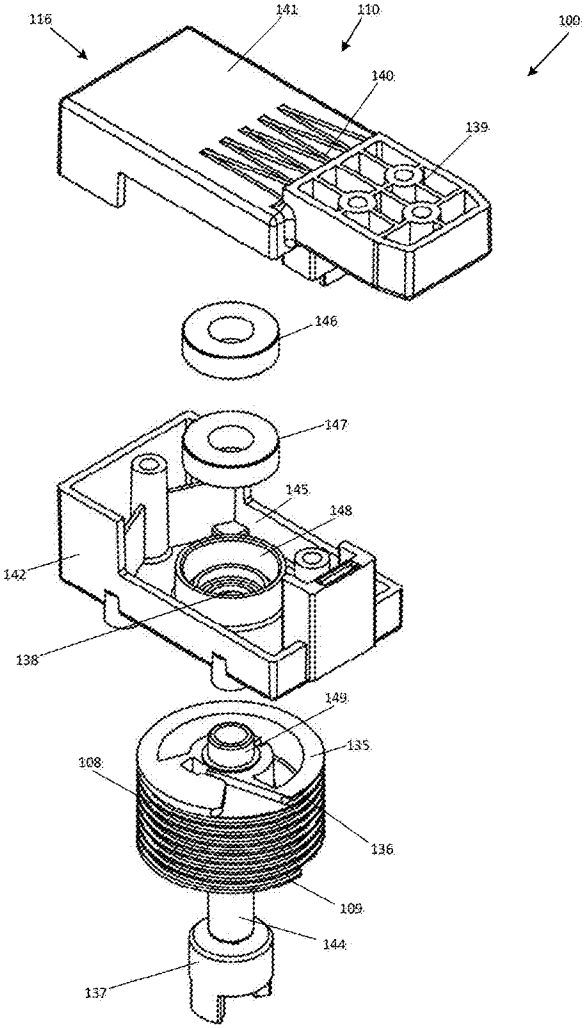
FIG. 16 is an exploded view of the spool drive box of FIG. 15, according to one aspect of the present disclosure.
Figure 17:
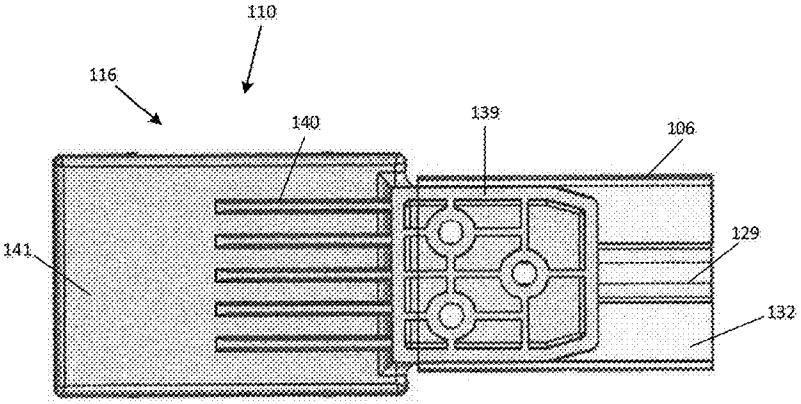
FIG. 17 is a top view of the spool drive box, according to one aspect of the present disclosure.
Figure 18:
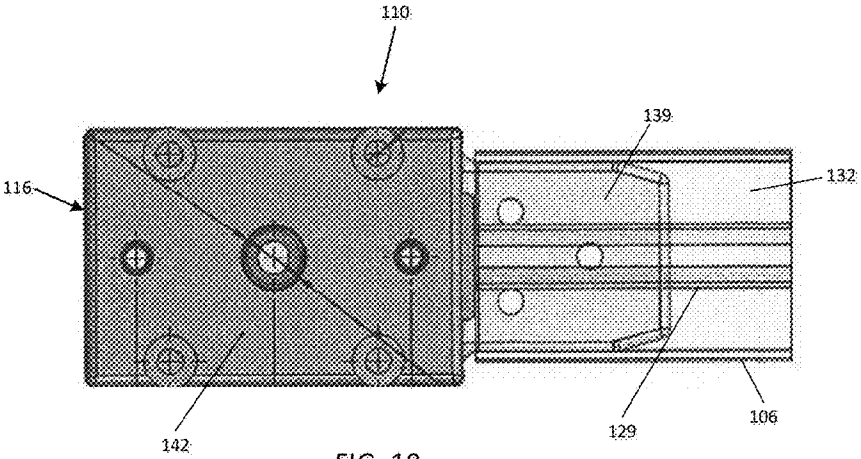
FIG. 18 is a bottom view of the spool drive box, according to one aspect of the present disclosure.
Figure 19:
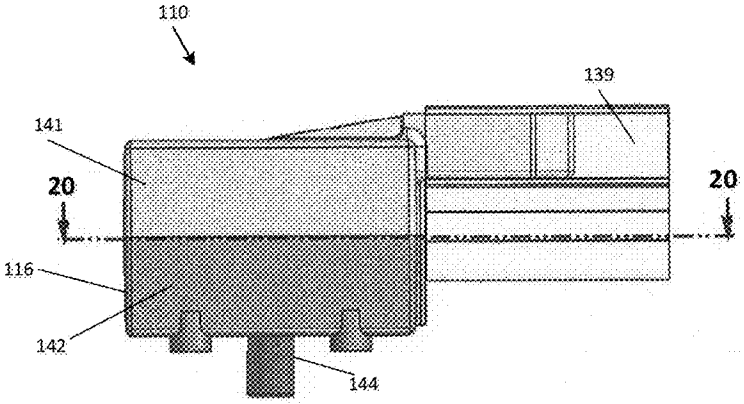
FIG. 19 is a side view of the spool drive box, according to one aspect of the present disclosure.
Figure 20:
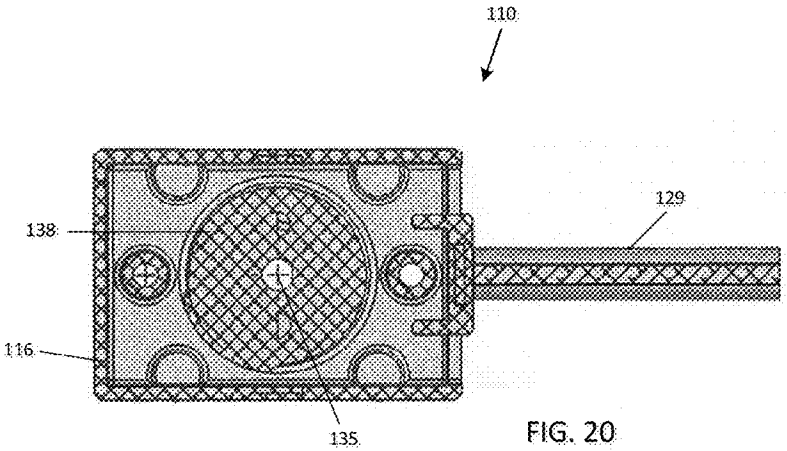
FIG. 20 is a cross-sectional view of the spool drive box taken along line 20-20 of FIG. 19, according to one aspect of the present disclosure.
Figure 21:
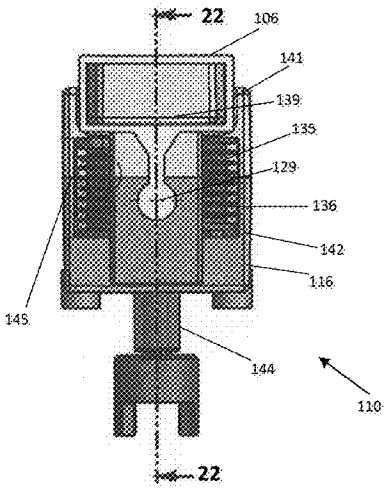
FIG. 21 is an end view of the spool drive box operatively engaged to a linear slide rail, according to one aspect of the present disclosure.

Referring to FIGS. 15 and 16, in some embodiments the spool drive component 110 includes a spool drive box 116 having an upper casing 141 coupled to a lower casing 142 that collectively defines a cavity 145 configured to receive a spool 135 disposed therein. In some embodiments, the spool 135 includes an axial rod 149 that extends axially from the spool 135 and is coupled to a spline 137 that connects the spool 135 to the drive 114 for rotation by the motor 107 when operating the spool drive component 110. In some embodiments, the lower casing 142 defines a recess 148 in communication with an axial channel 138 formed through the lower casing 142. The recess 148 is configured to receive the bottom portion of the spool 135 such that the axial rod portion 149 extends through the axial channel 138. The spool 135 defines a plurality of helical grooves 136 defined around the peripheral surface of the spool 135 which are configured to receive respective portions of the top cord 108 and bottom cord 109 such that the top cord 108 extends from one portion (e.g. top portion) of the spool 135 and the bottom cord extends from another portion (e.g. bottom portion) of the spool 135. In operation, rotation of the spool 135 in a clockwise direction causes the top cord 108 to be driven in the proximal direction B and the bottom cord 109 to be driven in the distal direction A, while rotation of the spool 135 in the counter-clockwise direction causes the top cord 109 to be driven in the distal direction A and the bottom cord 109 to be driven in the proximal direction B.

Figure 22:
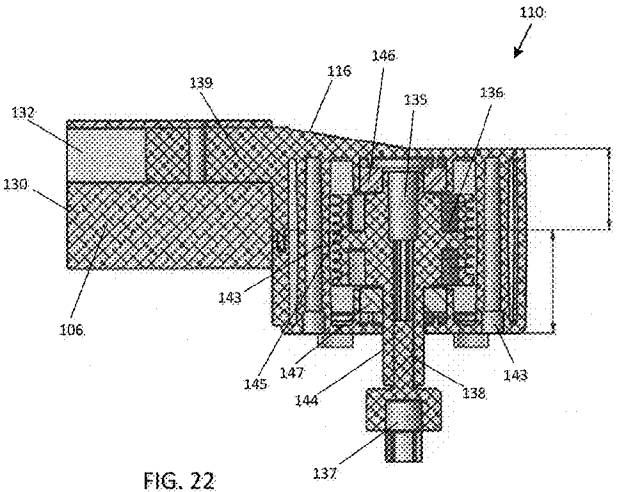
FIG. 22 is a cross-sectional view of the spool drive box taken long line 22-22 of FIG. 21, according to one aspect of the present disclosure.
Figure 23:
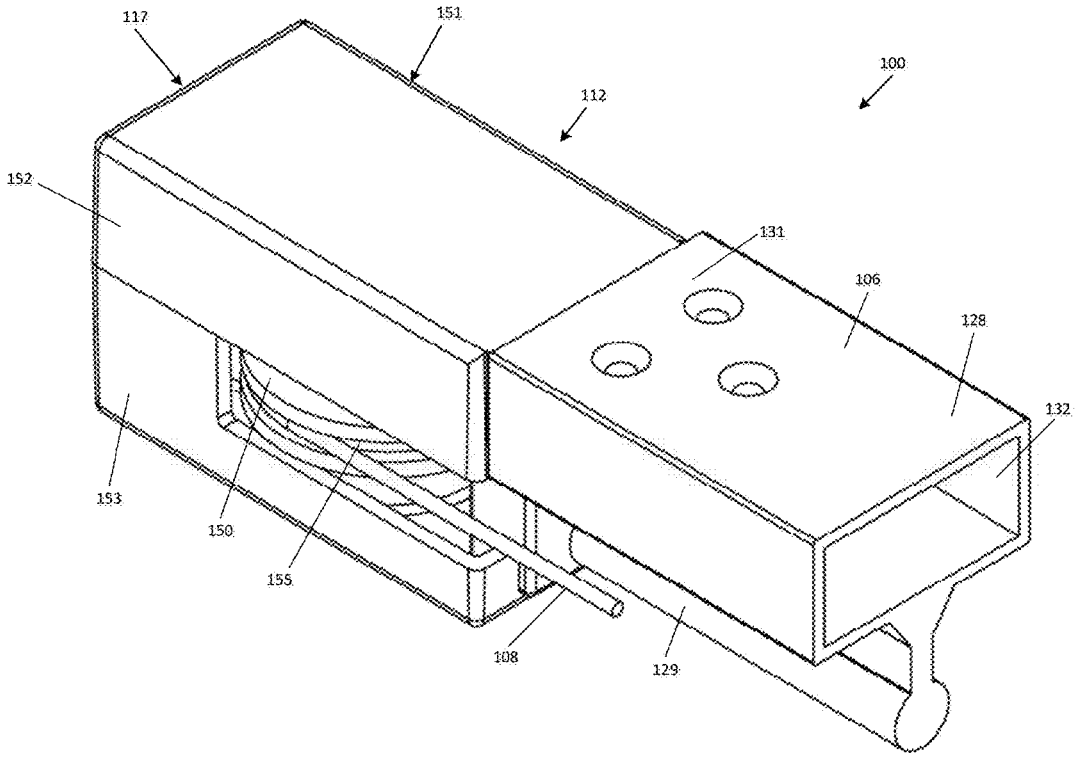
FIG. 23 is a perspective view of the pulley component of FIG. 2, according to one aspect of the present disclosure.
Figure 24:
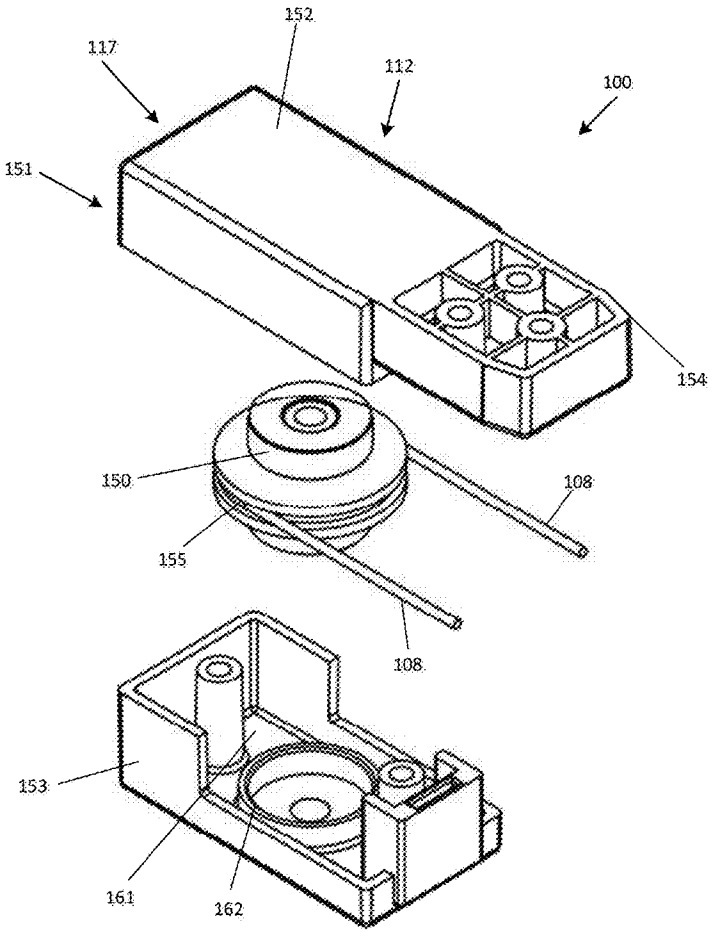
FIG. 24 is an exploded view of the pulley component of FIG. 23, according to one aspect of the present disclosure.

As shown in FIGS. 16 and 22, the spool drive component 110 may include a first bushing 146 coupled along the top portion of the spool 135 and a second bushing 147 coupled along the bottom portion of the spool 135 when assembled within the spool drive box 116. In some embodiments, the spool drive component 110 is operatively engaged to the motor 107 through the drive 114 (FIG. 31) which is connected to the axial rod portion 149 of the spool 135 through a spline 137 that extends through a channel 138 defined through an extension 144. Operation of the motor 107 causes the spline 137 to rotate the axial rod portion 149 which allows the spool 135, to be rotated in either the clockwise or counter-clockwise direction. As shown in FIG. 22, a plurality of securing members 143 may be used to couple the upper casing 141 to the lower casing 142.

In some embodiments, the upper casing 141 includes a tang 139 that extends outwardly in a lateral direction and configured to be received within the channel 132 through the distal open end 130 of the housing 128 when coupling the spool drive box 116 to the linear slide rail 106. In addition, the upper casing 142 further includes reinforcing ribs 140 that extend from the tang 130 and provide structural reinforcement to the spool drive box 116 and the connection with the linear slide rail 106.

Referring to FIGS. 23-30, the pulley component 112 includes a pulley box 117 having a housing 151 comprising an upper casing 152 coupled to a lower casing 153 that collectively define a cavity 161 configured to receive a spool 150 disposed therein. As shown in FIG. 30, the spool 150 defines a groove 155 formed around the peripheral edge of the spool 150 which is configured to receive the top cord 108 and allows a sliding engagement between the top cord 108 and the groove 155 when the spool drive component 110 drives the top cord 108. As shown specifically in FIG. 24, the lower casing 153 defines a seat 162 configured to receive the bottom portion of the spool 150 therein and permit the spool 150 to freely rotate about its axis when the top cord 108 is driven by the spool drive component 110. As shown in FIGS. 25-28, the upper casing 152 defines a tang 154 that extends laterally outward and is configured to be received through the proximal open end 131 and disposed within the channel 132 of the linear slide rail 106.

Figure 25:
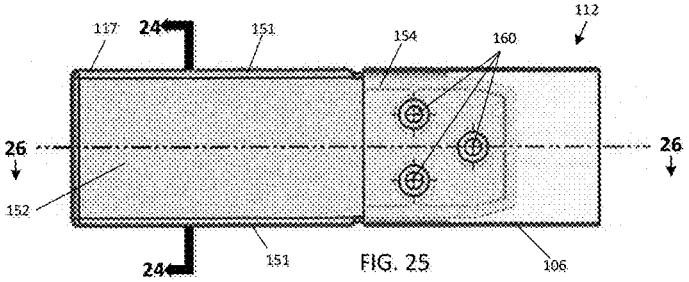
FIG. 25 is a top view of the pulley component, according to one aspect of the present disclosure.
Figure 27:
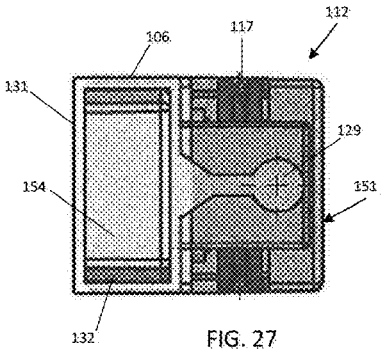
FIG. 27 is an end view of the pulley component engaged to the linear slide rail, according to one aspect of the present disclosure.
Figure 26:
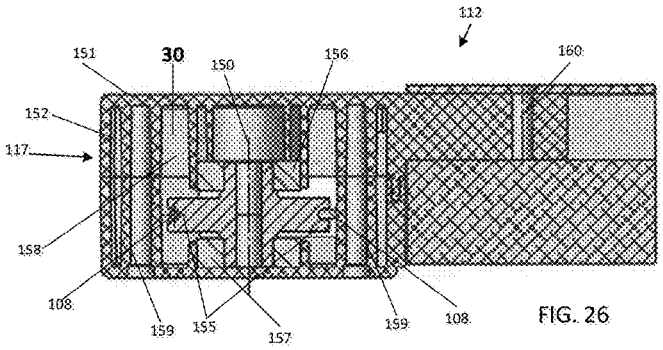
FIG. 26 is a cross-sectional view of the pulley component taken along line 26-26 of FIG. 25, according to one aspect of the present disclosure.

Referring specifically to FIG. 25, a plurality of securing members 160 may be used to secure the pulley component 112 to the linear slide rail 106 through the tang 154. As shown in FIGS. 25 and 29, a plurality of securing members 159 may be used to secure the upper casing 152 to the lower casing 153 to form the housing 151. When assembled, the pulley component 112 includes a bearing holder 158 disposed within the housing 151 and configured to engage a first bearing 156 positioned above the spool 150 and a second bearing 157 positioned below the spool 150 as illustrated in FIG. 26.

Referring back to FIG. 31, the automatic sliding door system 100 further includes a microprocessor 103 in operative communication with the motor 107 for controlling operation of the drive spool component 110 and the touch panel 164 when an individual desires to actuate the motor 107 through operation of the actuator 113. In some embodiments, the microprocessor 103 is in operative communication with a power source 111 for powering the various components of the automatic sliding door system 100.

In some embodiments, the microprocessor 103 is in operative communication with an encoder 115 for providing feedback data for determining the direction and distance the door panel 102 must travel from a present position of the door panel 102 to the instructed position the door panel 102 is instructed to assume by the encoder 115. In some embodiments, the encoder 115 may include multiple lines of resolution in which each line of resolution represents one of a plurality of possible positions the door panel 102 may be positioned by the slide and rail assembly 104. For example, the encoder 115 may be an optical disc having a 1,000 lines of resolution in which a respective pulse generated from each of the 1,000 lines of resolution equals one detected revolution of the encoder 115 for determining the position and distance of travel of the slide 105.

As noted above, the automatic sliding door system 100 is operable to allow an individual to apply a predetermined amount of pressure along the edge of the sliding door panel 102 to cause the door panel 102 to automatically slide to the open position. In particular, the encoder 115 may be programmed to detect a predetermined amount of pressure being applied to the door panel 102 by an individual such that the encoder 115 causes the motor 107 to move the sliding door panel 102 to the closed position. In operation, the encoder 115 detects the amount of pressure being applied to the sliding door panel 102 due to the slight movement imparted to the sliding door panel 102 as the one or more lines or resolution are energized by a respective pulse generated by movement of the sliding door panel 102. When a certain number of lines of resolution of the encoder 115 are energized, the encoder 115 causes the sliding door panel 102 to move to the open position. As such, the encoder 115 may be programmed to move the sliding door panel 102 to the closed position when the amount of pressure applied to the edge of the sliding door panel 102 is equal to a predetermined number of lines of resolution being energized in the encoder 115 due to the detected movement of the sliding door panel 102.

In addition, the microprocessor 103 may operate software that allows the automatic sliding door system 100 to adjust the amount of force required to actuate and slide the sliding door panel 102 in instances when an individual applies pressure directly to the sliding door panel 102.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. An automatic sliding door system comprising:

a sliding door panel disposed within an opening of a frame;

a slide coupled to the sliding door panel, the slide comprising:

a middle portion, a first side portion and a second side portion collectively defining an open channel in communication with a distal open end and an opposite proximal open end, the middle portion defining a runner portion forming an open channel extending along a length of the slide;

a linear slide rail in sliding engagement with the slide, the linear slide rail comprising:

a housing defining a channel in communication between a distal open end and a proximal open end; and a linear run extending along the housing between the distal open end and the proximal open end, the linear run being configured to be received in the open channel of the runner portion, wherein the runner portion of the slide is in sliding engagement with the linear run of the linear slide rail;

a spool drive component coupled to the distal open end of the linear slide rail, the spool drive component comprising a first spool operatively coupled to a top cord and a bottom cord; and a pulley component coupled to the proximal open end of the linear slide rail, the pulley component comprising a second spool operatively coupled to the top cord;

a motor operatively coupled to the spool drive component for driving the top cord and the bottom cord in different directions, respectively;

a microprocessor in operative communication with the motor for controlling operation of the spool drive component; and an encoder in operative communication with the microprocessor for providing feedback to the microprocessor regarding the position and direction of movement of the sliding door panel, the encoder determining a respective position of a plurality of positions of the sliding door panel relative to the frame, and wherein the encoder is programmed to detect a predetermined amount of pressure being applied to the door panel by an individual, and the microprocessor executes software instructions for adjusting a force for actuating and sliding the sliding door panel corresponding to the predetermined amount of pressure being applied to the sliding door panel.

2. The automatic sliding door system of claim 1, further comprising:

an actuator in operative communication with the microprocessor for controlling the spool drive component.

3. The automatic sliding door system of claim 2, wherein the actuator is in operative communication with a touch panel for providing remote or direct operation of the actuator.

4. The automatic sliding door system of claim 1, wherein the first spool defines a helically shaped groove configured to receive the top cord and bottom cord.

5. The automatic sliding door system of claim 1, wherein the second spool defines a circumferential groove configured to receive the top cord.

6. The automatic sliding door system of claim 1, wherein the spool drive component defines a laterally extending tang configured to engage the spool drive component to the linear slide rail and wherein the pulley component defines a laterally extending tang configured to engage the pulley component to the linear slide rail.

7. The automatic sliding door system of claim 1, further comprising a power source for providing power to the microprocessor, the motor, and an actuator.

8. The automatic sliding door system of claim 1, wherein the encoder comprises an optical disc.

9. The automatic sliding door system of claim 1, wherein the top cord and bottom cord extend along the channel of the linear slide rail.

* * * * *